US010770042B1

(12) United States Patent
Liao

(10) Patent No.: US 10,770,042 B1
(45) Date of Patent: Sep. 8, 2020

(54) ROD HOLDER FOR MUSICAL INSTRUMENT

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 16/703,264

(22) Filed: Dec. 4, 2019

(51) Int. Cl.
*G10D 13/02* (2020.01)
*G10D 13/10* (2020.01)

(52) U.S. Cl.
CPC ..... *G10D 13/02* (2013.01); *G10D 13/28* (2020.02)

(58) Field of Classification Search
CPC ..... G10D 13/02; G10D 13/28
See application file for complete search history.

(56) References Cited

U.S. PATENT DOCUMENTS 1,706,215 A * 3/1929 Davidson ..... E04G 7/16 403/97
3,937,451 A * 2/1976 DiPaola ..... B25B 5/006 269/45
4,566,819 A * 1/1986 Johnston ..... E04G 7/14 403/385
4,817,897 A * 4/1989 Kreusel ..... E04B 1/585 248/68.1
5,017,038 A * 5/1991 Kurosaki ..... E04G 7/16 24/335
6,093,878 A * 7/2000 Hoshino ..... G10D 13/06 248/122.1
6,096,956 A * 8/2000 Hoshino ..... G10D 13/06 84/421
6,344,605 B1 * 2/2002 Liao ..... G10D 13/02 84/421
8,367,918 B2 * 2/2013 Reyes ..... G10D 13/02 84/421
9,251,771 B1 * 2/2016 Hsu ..... G10G 5/00
9,310,021 B2 4/2016 Hennessey et al.
9,633,635 B2 4/2017 Liao
9,903,408 B2 * 2/2018 Liao ..... G10D 13/02
10,161,563 B1 * 12/2018 Liao ..... F16B 2/10
10,529,308 B1 * 1/2020 Liao ..... G10D 13/02
2010/0278585 A1 * 11/2010 Yi ..... G10D 13/28 403/103
2012/0118126 A1 * 5/2012 Sato ..... G10D 13/28 84/421
2014/0026737 A1 * 1/2014 Sato ..... G10D 13/28 84/421

* cited by examiner

*Primary Examiner* — Robert W Horn
(74) *Attorney, Agent, or Firm* — Muncy, Geissler, Olds & Lowe, P.C.

(57) ABSTRACT

A rod holder for musical instrument used for adjusting relative angles of two musical instrument rods, comprising two clamp sets clamping the two musical instrument rods and a connecting ring, respectively. Each clamp set comprises a fixed clamping block, a movable clamping block, a locking member and a cylindrical portion. One surface of the fixed clamping block and one surface of the movable clamping block which correspond to each other are respectively recessed inwardly and face to each other to form a clamping groove, and one side of the cylindrical portion opposite to the clamping groove is disposed with a circular disk. The connecting ring comprises two approximately circular grooves, and the two circular disks are respectively disposed in the two approximately circular grooves. The two circular disks rotate in the two approximately circular grooves to allow the two clamp sets capable of rotating relative to the connecting ring.

5 Claims, 4 Drawing Sheets

ROD HOLDER FOR MUSICAL INSTRUMENT

FIELD OF THE INVENTION

The present invention relates to a support structure for musical instrument rods, and more particularly to a holder for adjusting angles at which musical instrument rods are disposed.

BACKGROUND OF THE INVENTION

During a musical performance, it is required to set up a variety of musical instruments for performers to use. A performer will use a musical instrument rod fixing structure provided in FIG. 1 of the U.S. Pat. No. 9,633,635 B2 to fix two musical instrument rods. Each musical instrument rod is disposed a musical instrument such as cymbal, drum, cow bell, etc. Therefore, two musical instruments can be fixed at the same time by the side of the performer.

During a musical performance, the performer will need to adjust a disposing angle of a musical instrument. Therefore, the performer also uses a rotary joint provided in U.S. Pat. No. 9,310,021 B2. The rotary joint comprises a lower joint and an upper joint. After the rotary joint is rotated and loosened, a user can rotate and change relative angles of the upper joint and the lower joint. When the performer fixes the musical instrument to the upper joint and changes the relative angles of the upper joint and the lower joint, the disposing angle of the musical instrument can be adjusted to meet the need of the musical performance.

The musical instrument rod fixing structure described above cannot meet the need of adjusting the disposing angle of the musical instrument. Even though the rotary joint mentioned above allows the user to adjust the disposing angle of the musical instrument, the structure of the rotary joint is too complicated to be adjusted. Specifically, during adjustment, the user is required to first rotate and loosen the rotary joint to allow an engaging teeth portion (the element 68 shown in FIG. 5 of U.S. Pat. No. 9,310,021 B2) to be completely disengaged from a corresponding teeth portion (the element 58 shown in FIG. 5 of U.S. Pat. No. 9,310,021 B2) before adjusting. After adjustment, the engaging teeth portion is re-engaged with the corresponding teeth portion before tightening the rotary joint, which is quite troublesome in operation, and obviously cannot meet the requirements in usage.

SUMMARY OF THE INVENTION

Therefore, a main object of the present invention is to disclose a rod holder for musical instrument that is simple in structure and fairly convenient in operation.

In order to achieve the above object, the present invention is a rod holder for musical instrument comprising two clamp sets and a connecting ring, wherein each clamp set comprises a fixed clamping block, a movable clamping block, a locking member and a cylindrical portion. The locking member drives the movable clamping block to move toward the fixed clamping block. One surface of the fixed clamping block and one surface of the movable clamping block which correspond to each other are respectively recessed inwardly and face to each other to form a clamping groove. The cylindrical portion is connected to the fixed clamping block, and one side of the cylindrical portion opposite to the clamping groove is disposed with a circular disk.

The connecting ring comprises two arcuate members, a first end of one of the two arcuate members is pivotally connected to a first end of another arcuate member by a hinge, and a second end of one of the two arcuate members is fixedly connected to a second end of another arcuate member by a pressing member. Thus, the two arcuate members are assembled to form an inner ring surface and two approximately circular grooves, and the two approximately circular grooves are located at the inner ring surface. The two circular disks of the two clamp sets are respectively disposed in the two approximately circular grooves in a rotatable manner, and the pressing member presses the two second ends of the two arcuate members to force the two second ends to be relatively closer to each other and reduce the two approximately circular grooves, the two circular disks are respectively clamped and fixed by the two approximately circular grooves.

Accordingly, the design of the two circular disks respectively rotating in the two approximately circular grooves allows the two clamp sets capable of rotating relative to the connecting ring, and thus relative angles of the two clamp sets can be changed. Moreover, the two clamp sets clamp a musical instrument rod through the clamping groove, respectively. Therefore, relative angles of the two musical instrument rods can be adjusted by adjusting the relative angles of the two clamp sets, and also meets the requirements in operation. Further, the circular disk is rotatably disposed in the approximately circular groove, when the pressing member presses and reduces the approximately circular groove to clamp and fix the circular disk, a user can still force the circular disk to rotate by resisting a clamping force of the approximately circular groove. Thus, the relative angles of the two clamp sets can still be changed, which is quite simple and convenient in operation and can meet the requirements in usage.

DETAILED DESCRIPTION OF THE PREFERRED EMBODIMENTS

The technical contents, features and efficacies of the present invention are clearly presented in the following detailed description of the preferred embodiments with reference to the accompanying drawings.

Figure 1:
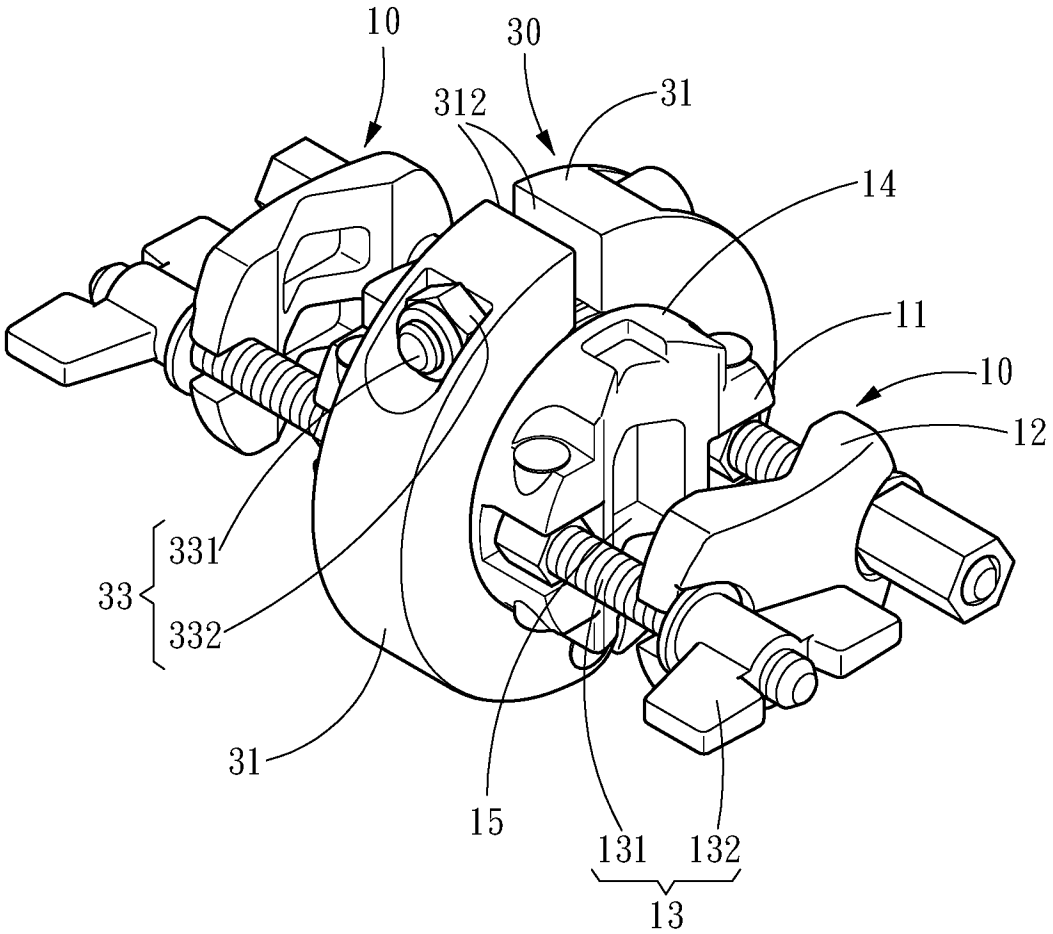
FIG. 1 is a perspective assembly view of the structure of a rod holder for musical instrument of the present invention.
Figure 2:
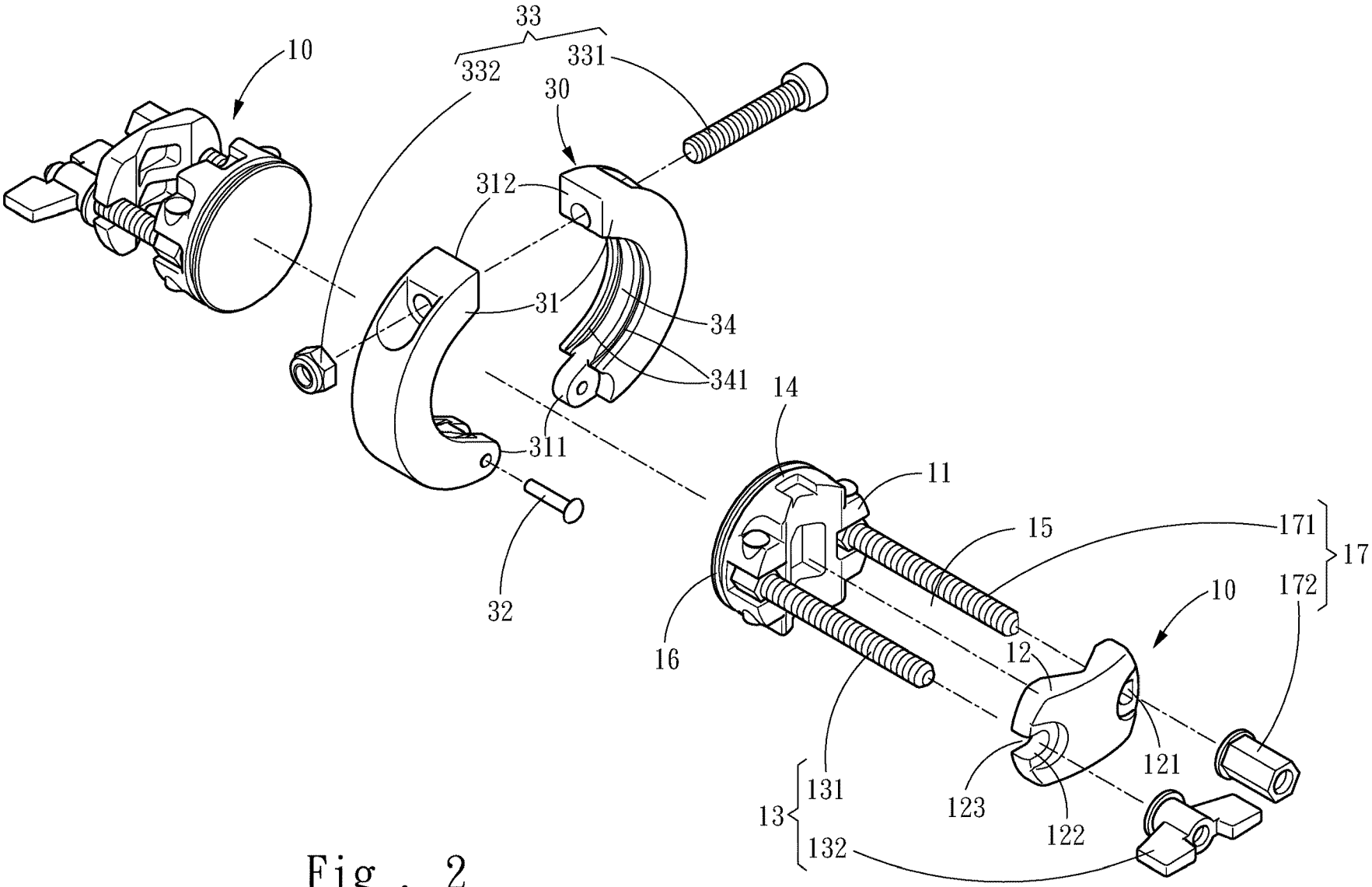
FIG. 2 is an exploded perspective view of the structure of the rod holder for musical instrument of the present invention.

Please refer to FIG. 1 and FIG. 2, the present invention is a rod holder for musical instrument comprising two clamp sets 10 and a connecting ring 30, wherein each clamp set 10 comprises a fixed clamping block 11, a movable clamping block 12, a locking member 13, and a cylindrical portion 14. The locking member 13 drives the movable clamping block 12 to move toward the fixed clamping block 11. One surface of the fixed clamping block 11 and one surface of the movable clamping block 12 which correspond to each other are respectively recessed inwardly and face to each other to form a clamping groove 15. The cylindrical portion 14 is connected to the fixed clamping block 11, and one side of the cylindrical portion 14 opposite to the clamping groove 15 is disposed with a circular disk 16.

The locking member 13 comprises a bolt 131 and a manual rotating knob 132. The bolt 131 is pivotally connected to the fixed clamping block 11 and passes through the movable clamping block 12. The manual rotating knob 132 is screwed to the bolt 131 and pushes the movable clamping block 12 to move toward the fixed clamping block 11.

In addition, the clamp set 10 further includes a spacing adjustment component 17. The spacing adjustment component 17 comprises a non-circular bolt 171 and a nut 172. The non-circular bolt 171 is pivotally connected to the fixed clamping block 11 and passes through the movable clamping block 12. The nut 172 is screwed to the non-circular bolt 171 and pushes the movable clamping block 12 to move toward the fixed clamping block 11. The movable clamping block 12 comprises a non-circular through hole 121, the non-circular through hole 121 is provided for the non-circular bolt 171 to pass through, and the non-circular through hole 121 restrains the non-circular bolt 171 from rotating axially relative to the non-circular through hole 121. The spacing adjustment component 17 and the locking member 13 are respectively located by two sides of the movable clamping block 12.

In addition, the movable clamping block 12 comprises a groove 122, the groove 122 is provided for the bolt 131 to pass through, and a side of the groove 122 opposite to the clamping groove 15 comprises a side opening 123.

The connecting ring 30 comprises two arcuate members 31, a first end 311 of one of the two arcuate members 31 are pivotally connected to a first end of another arcuate member by a hinge 32, and a second end 312 of one of the two arcuate members 31 are fixedly connected to a second end of another arcuate member by a pressing member 33. Thus, the two arcuate members 31 are assembled to form an inner ring surface 34 and two approximately circular grooves 341, and the two approximately circular grooves 341 are located at the inner ring surface 34. The two circular disks 16 of the two clamp sets 10 are respectively disposed in the two approximately circular grooves 341 in a rotatable manner, and the pressing member 33 is capable of pressing the two second ends 312 to force the two second ends to be relatively closer to each other, thereby reducing the two approximately circular grooves 341, and the two circular disks 16 are respectively clamped and fixed by the two approximately circular grooves 341.

The pressing member 33 comprises a pressing bolt 331 and a pressing nut 332. The pressing nut 332 is screwed to the pressing bolt 331, and the pressing bolt 331 passes through the two arcuate members 31. Thus, the two second ends 312 are closed to each other through the compression of the pressing nut 332.

Figure 3:
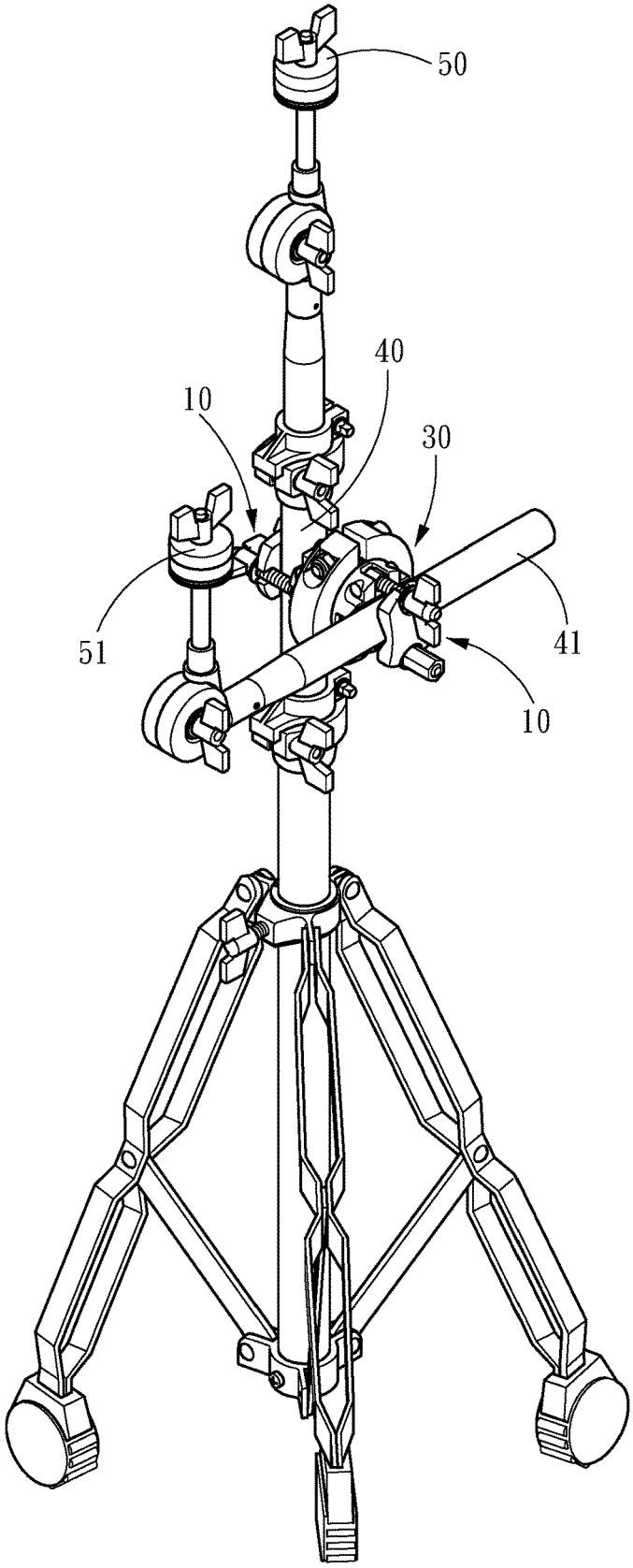
FIG. 3 is a schematic view of the rod holder for musical instrument of the present invention while using

Please refer to FIG. 3, the two clamp sets 10 are used to clamp musical instrument rods 40, 41, respectively, and the two musical instrument rods 40, 41 are provided for installing cymbal clamps 50, 51, respectively. The two cymbal clamps 50, 51 are respectively provided for installing a cymbal (not shown in the figure).

Figure 4:
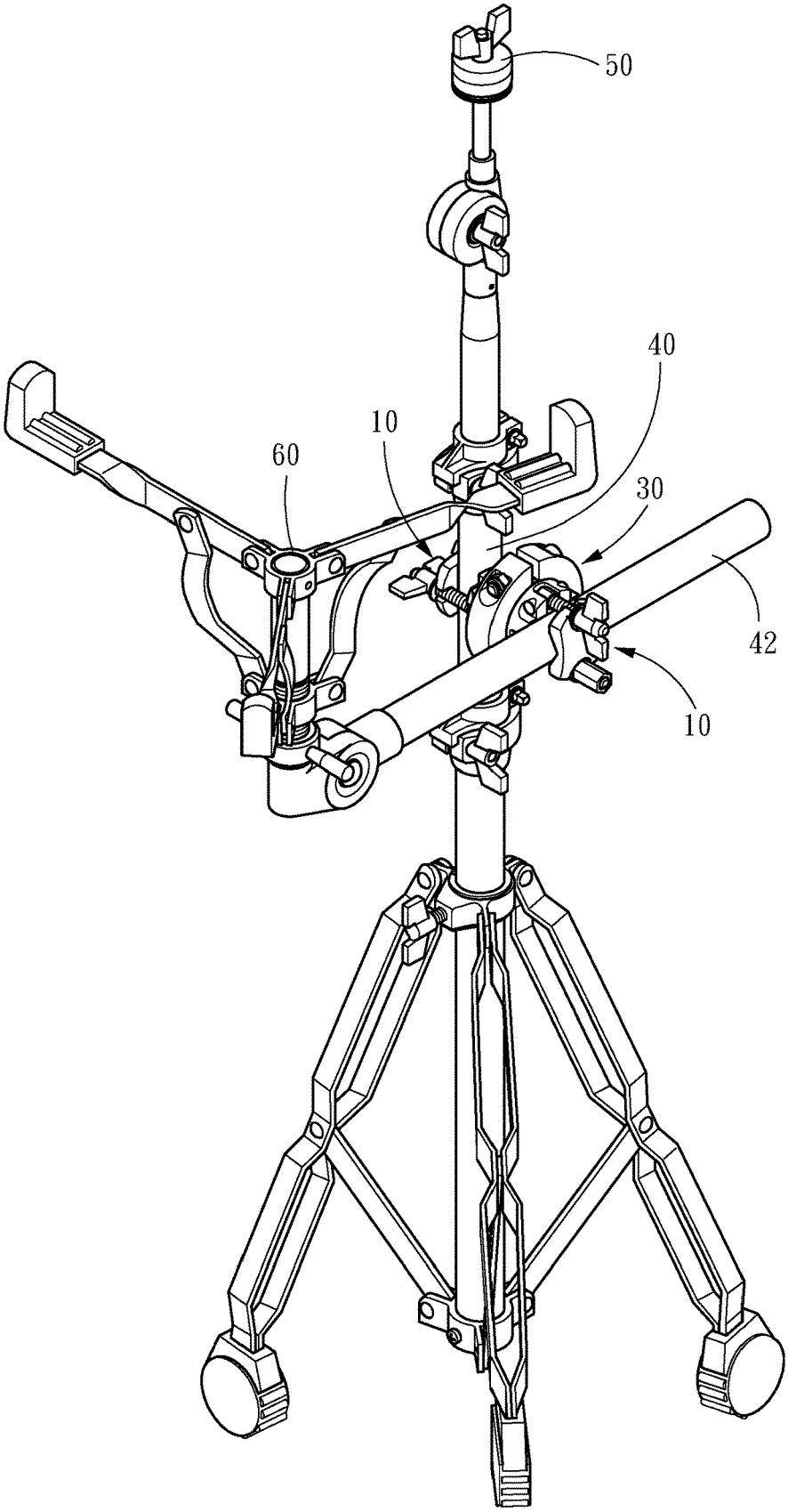
FIG. 4 is another schematic view of the rod holder for musical instrument of the present invention while using.

Alternatively, please refer to FIG. 4. One of the clamp sets 10 is used to clamp a musical instrument rod 42. The musical instrument rod 42 is provided for installing a drum rack 60, and the drum rack 60 is provided for mounting a drum musical instrument (not shown in the figure).

As described above, features of the present invention are:

1. The design of the two circular disks respectively rotating in the two approximately circular grooves allows the two clamp sets capable of rotating freely relative to the connecting ring, and thus relative angles of the two clamp sets can be changed. Moreover, the two clamp sets clamp the musical instrument rods through the clamping groove, respectively. Therefore, relative angles of the musical instrument rods can be adjusted by adjusting the relative angles of the two clamp sets.

2. When the pressing member presses and reduces the approximately circular groove to clamp and fix the circular disk, a user can still force the circular disk to rotate by resisting a clamping force of the approximately circular groove, so that the relative angles of the two clamp sets can still be changed, which is quite simple and convenient in operation.

3. The structure of the invention is simple, the processing is easy and the assembly is fast, and the manufacturing cost is effectively reduced.

What is claimed is:

1. A rod holder for musical instrument, comprising:

two clamp sets, each clamp set comprising a fixed clamping block, a movable clamping block, a locking member driving the movable clamping block to move toward the fixed clamping block, and a cylindrical portion connected to the fixed clamping block, one surface of the fixed clamping block and one surface of the movable clamping block which correspond to each other respectively recessed inwardly and facing to each other to form a clamping groove, and one side of the cylindrical portion opposite to the clamping groove disposed with a circular disk; and a connecting ring, comprising two arcuate members, a first end of one of the two arcuate members pivotally connected to a first end of another arcuate member by a hinge, and a second end of one of the two arcuate members fixedly connected to a second end of another arcuate member by a pressing member, the two arcuate members assembled to form an inner ring surface and two approximately circular grooves located at the inner ring surface, wherein the two circular disks of the two clamp sets are respectively disposed in the two approximately circular grooves in a rotatable manner, and the pressing member presses the two second ends of the two arcuate members to force the two second ends to be relatively closer to each other and reduce the two approximately circular grooves, the two circular disks are respectively clamped and fixed by the two approximately circular grooves.

2. The rod holder for musical instrument as claimed in claim 1, wherein the locking member comprises a bolt pivotally connected to the fixed clamping block and passing through the movable clamping block, and a manual rotating knob screwed to the bolt and pushing the movable clamping block to move toward the fixed clamping block.

3. The rod holder for musical instrument as claimed in claim 2, wherein the clamp set includes a spacing adjustment component, the spacing adjustment component comprises a non-circular bolt pivotally connected to the fixed clamping block and passing through the movable clamping block, and a nut screwed to the non-circular bolt and pushing the movable clamping block to move toward the fixed clamping block, the movable clamping block comprises a non-circular through hole provided for the non-circular bolt to pass through and restraining the non-circular bolt from rotating axially, and the spacing adjustment component and the locking member are respectively located by two sides of the movable clamping block.

4. The rod holder for musical instrument as claimed in claim 3, wherein the movable clamping block comprises a groove provided for the bolt to pass through, and a side of the groove opposite to the clamping groove comprises a side opening.

5. The rod holder for musical instrument as claimed in claim 1, wherein the pressing member includes a pressing bolt and a pressing nut screwed to the pressing bolt, the pressing bolt passes through the two arcuate members, and the two second ends are relatively closer to each other through the compression of the pressing nut.

* * * * *